US007316040B2

(12) United States Patent
Siccardi et al.

(10) Patent No.: US 7,316,040 B2
(45) Date of Patent: Jan. 8, 2008

(54) SYSTEM AND METHOD FOR POSITIONING PATIENT LIMBS DURING SURGICAL PROCEDURES

(75) Inventors: Francesco Siccardi, Sonvico (CH); Frederic Laude, Gordola (CH); Mattia Berguglia, Gordola (CH)

(73) Assignee: Medacta International S.A., Castel San Pietro (CH)

( * ) Notice: Subject to any disclaimer, the term of this patent is extended or adjusted under 35 U.S.C. 154(b) by 268 days.

(21) Appl. No.: 11/147,446

(22) Filed: Jun. 8, 2005

(65) Prior Publication Data

US 2005/0268400 A1 Dec. 8, 2005

(30) Foreign Application Priority Data

Jun. 8, 2004 (FR) ..... 04 06271

(51) Int. Cl.
*A61G 13/12* (2006.01)

(52) U.S. Cl. ..... 5/621; 5/624; 5/648

(58) Field of Classification Search ..... 5/621–624, 5/646–651
See application file for complete search history.

(56) References Cited

U.S. PATENT DOCUMENTS

| | | | | |
|---|---|---|---|---|
| 3,389,702 | A * | 6/1968 | Kennedy | 606/119 |
| 3,745,996 | A * | 7/1973 | Rush, Sr. | 602/39 |
| 4,527,555 | A * | 7/1985 | Ruf | 602/39 |
| 4,624,245 | A * | 11/1986 | Mullin et al. | 602/38 |
| 5,645,079 | A | 7/1997 | Zahiri et al. | |
| 5,742,962 | A * | 4/1998 | Yoshino et al. | 5/623 |
| 7,246,390 | B2 * | 7/2007 | Mitsuishi et al. | 5/648 |
| 2003/0028967 | A1 | 2/2003 | Schuerch | |
| 2005/0268400 | A1 * | 12/2005 | Siccardi et al. | 5/621 |

* cited by examiner

*Primary Examiner*—Robert G. Santos
(74) *Attorney, Agent, or Firm*—Dickstein Shapiro LLP

(57) ABSTRACT

A system to facilitate surgical operations by optimally positioning limbs of patients lying on a surgery table. The system comprises a surgery table and a converter. The converter comprises five sub-systems with varying degrees of freedom.

9 Claims, 6 Drawing Sheets

SYSTEM AND METHOD FOR POSITIONING PATIENT LIMBS DURING SURGICAL PROCEDURES

BACKGROUND OF THE INVENTION

1. Field of the Invention

The present invention concerns a system to perform, under optimal conditions, surgical operations on animal body limbs.

In particular the invention relates to a system to perform, under optimal conditions, surgical operations on animal body limbs of patients lying on a surgical table connected to a converter.

More particularly the invention concerns a converter system to be coupled with, to regulate and to centrally command tables, beds, supports of extended patients who have to undergo surgical operations to the inferior limbs such as the legs mal body limbs of patients lying on a surgical table connected to a converter.

2. Description of the Prior Art

The operations of animal, human body limbs are generally practiced by lying the patient on a surgical table which is generally provided with restricted functional means or members to reach the best patient position over the surgeon. Normally such tables are vertically adjustable with the aid of poor associated means. There are, however, many surgical operations which need positioning and specific functions of great importance for the best success of the operations.

Just to fix the ideas (without introducing restrictions), for the operations of the inferior limbs, e.g. associated to the ankle, the patient or, better, the limbs in question must be capable of taking critical positions over the surgeon, all the more that the limbs have often to undergo traction or stretching efforts.

Up to now and at the best of our knowledge there are no systems capable of answering at least partially all the pre-operative functions preferably with the aid of means centralized and easy to reach by the surgical team.

U.S. Pat. No. 5,645,079 (to Zahiri H. et al) describes an orthopedic apparatus which includes:

a clamping section comprising a cross bar, with two clamping blocks at its opposite ends and a sliding block;

a tilting section including a gear box attached to said sliding block and a tilting part tiltably connected to said gear box;

a swinging section including a gear box connected to the tilting part and a swingable part swingably connected to the gear box; and an extended rotatable section including a gear box connected to the tilting part and to a sliding track rotatably connected to the gear box.

U.S. patent Publication No. 2003/0028967 describes a device consisting of:—a base attachable to a surgical table;—a post attachable by clamp;—a support arm pivotally attachable to the base;—and an expandable and retractable position actuator pivotally mounted on both said support arm and base.

BACKGROUND OF THE INVENTION

A first object of the present invention is to provide a system which eliminates the inconveniences and the gaps of the Prior Art. Another object is to provide a hospital converter system showing the advantages of being compact and compatible with all types of conventional surgical tables with the additional advantage of being controllable and activated by concentrated devices immediately accessible to the surgical team.

A further object is a method to simply operate said systems and the relevant devices.

Typically the converter system according to the invention carries out the surgical operations on the inferior limbs of a patient in an extended position, under optimized conditions.

The system comprises at least:

a first multi-functional articulated sub-system (101) with an articulation to couple and connect to an extension base, with at least three degrees of freedom;

a second sub-system (102) of support and movement of the patient limb coupling means, with at least two degrees of freedom;

a third sub-system (103) associated to said second sub-system (102) with at least one degree of freedom between said second sub-system (102) and the following sub-system (104);

a fourth sub-system (104) of interconnections between said third sub-system and the next sub-system (105) of said member coupling means with at least one degree of freedom over (103); and a fifth sub-system (105) of articulation and support of said patient member with at least three degrees of freedom.

In a first embodiment the system of the invention shows further preferred characteristics separately or in combination wherein:

a) sub-system (101) is a hinge mechanism;

b) sub-system (102) is a binary track provided with holes or slits of linear fixation of sub-system (103) and of rotation over a vertical axis;

c) sub-system (103) is a carriage mechanism provided of means for its translation, for the rotation of sub-system (102), and for the traction of the limb to be operated;

d) to said carriage are associated means for engagement within the holes or slits of the track, as well as a toothed wheel: a plate penetrates within the empty spaces between the wheel teeth to determine the position of sub-system (103), (104) and (105);

e) sub-system (104) is a shoe in particular a hinge which matches and fits the limb foot; and f) said sub-systems are assembled together in the operative phase whereas the command means are associated to the carriage in the initial phase of rough positioning.

In a preferred embodiment of the invention, the system includes a sixth sub-system (106) to optimize the limb position over the surgeon, including means (111) to feed and control a compressed fluid flow (112) to an elastic pneumatically modifiable body (107) e.g. in the form of a cushion, small mattress, elongated balloon, located under the lying patient; the feeding and regulating means (111) being associated to the converter system (110) whereas the pneumatically modifiable body may preferably be embedded in the lying patient supporting table (106). The means (111) of the sub-system (106) are activated by the surgical team to finely regulate the height, distance, inclination of the limb over the surgeon.

The various aspects and advantages of the invention will become apparent from the following detailed description, discussion and appended claims, taken in conjunction with the accompanying drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Briefly described, the invention is a converter system carrying centralized command means of associated sub-systems acting on the surgical table accommodating the patient to be operated, to reach the optimal position of the patient limbs over the surgeon.

Figure 1:
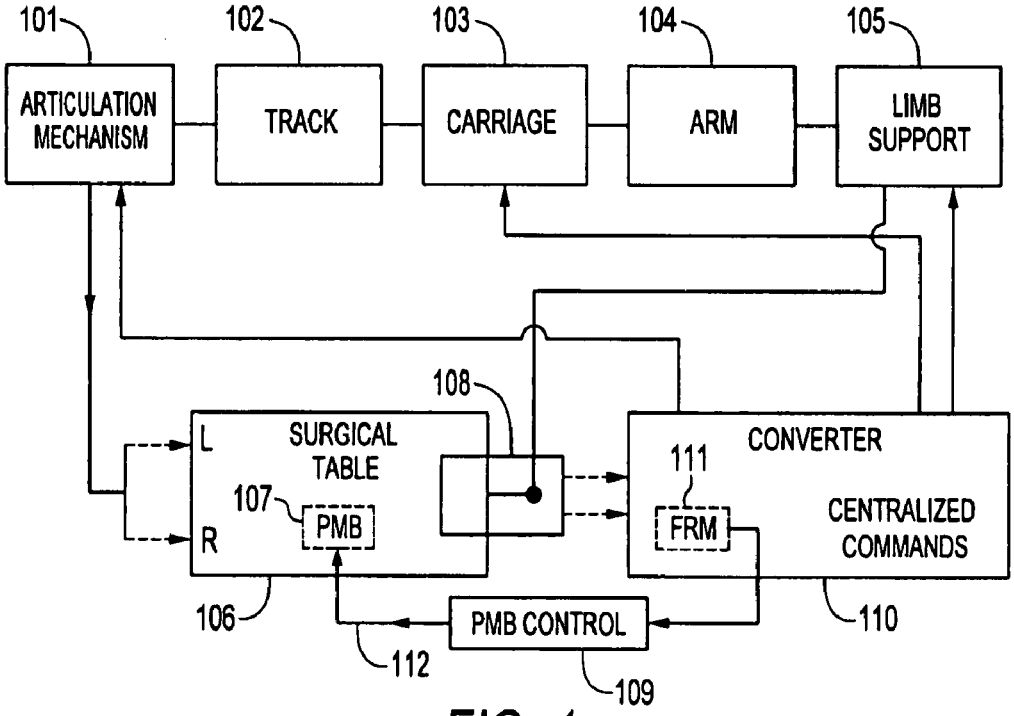
FIG. 1 is a block scheme of the converter system according to the invention.

The system of FIG. 1 comprises the surgical table (106) and the converter system of the invention comprising at least:

a first sub-system (101) preferably involving an articulation mechanism in a stationary special position;

a second sub-system (102) preferably in form of a binary track (301, 302) associated at one of its ends to said sub-system (101) in such a way to consent to said (102) at least two degrees of freedom;

a third sub-system (103) preferably in form of a carriage associated to said articulated binary track (301, 302);

a forth sub-system (104) preferably in form of an arm connected at one of its ends to sub-system (103) over which it has at least one degree of freedom; and a fifth sub-system (105), preferably in form of a patient limb support (703), having at least three degrees of freedom.

The converter system comprises a connection or interface (313) with a coupling means, e.g. a hole or slit (314), which corresponds to a pivot of the surgical table (106) so to bring about the articulated clamping to said system of the invention.

Said articulation of sub-system (101) comprises also a mechanism preferably in the form of a hinge, which is accommodated with its male expansions (305, 307) within the opening base of the female expansion (306, 308) of the base (309) of (101), which has on its turn, two lateral expansions (310, 311) for the application of the ends of arms (301) and (302) of the track.

In the represented case, a hole (312) offers the housing to a pivot (not shown).

The sub-system (102) comprises the two bodies forming the binary track, (301) and (302) and additionally has a third tubular element (303) parallel to (301) and (302), preferably at the center of these last elements. Element (303) works substantially as a means to locate the carriage in the positions established in the pre-operative phase schematically represented by the series of holes or (even better) slits (405-408).

Figure 2:
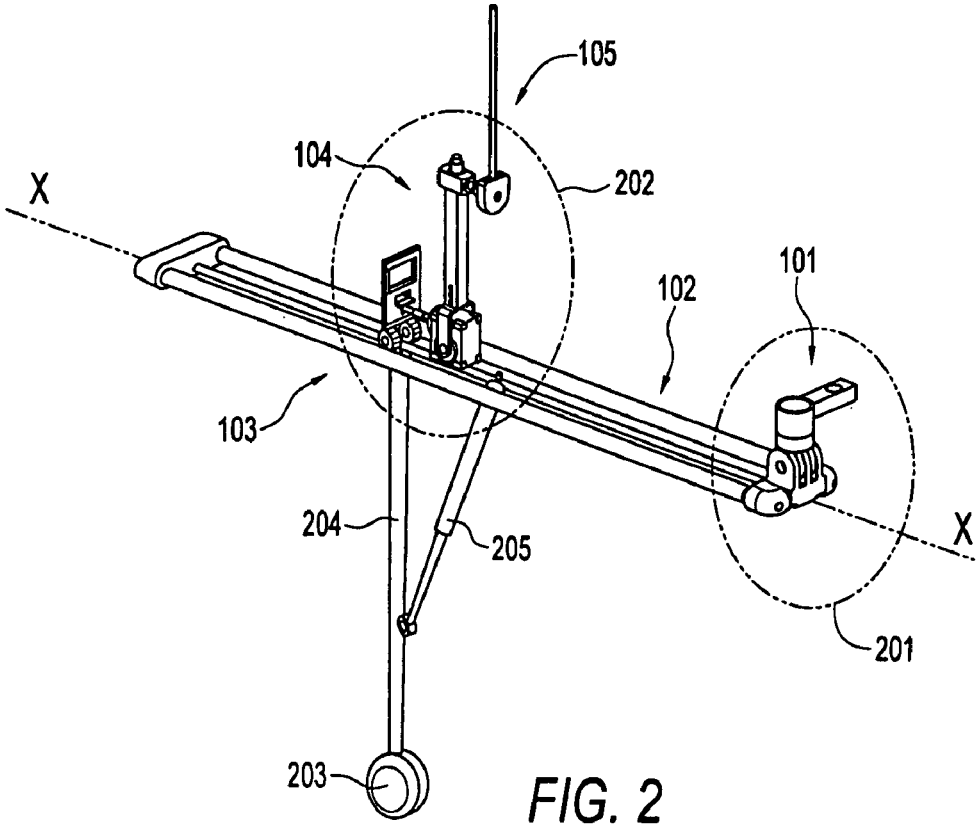
FIGS. 2, 3, 4, 4A, and 5 are prospective views of an equipment to embody said system.
Figure 3:
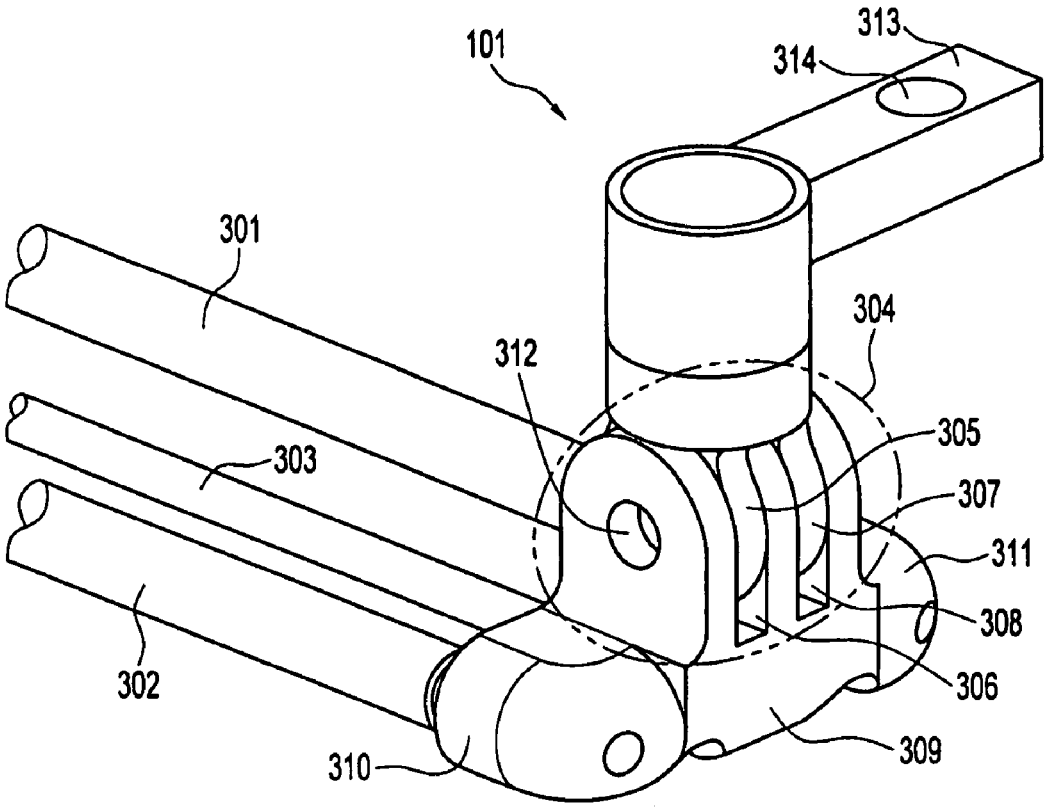
Figure 4A:
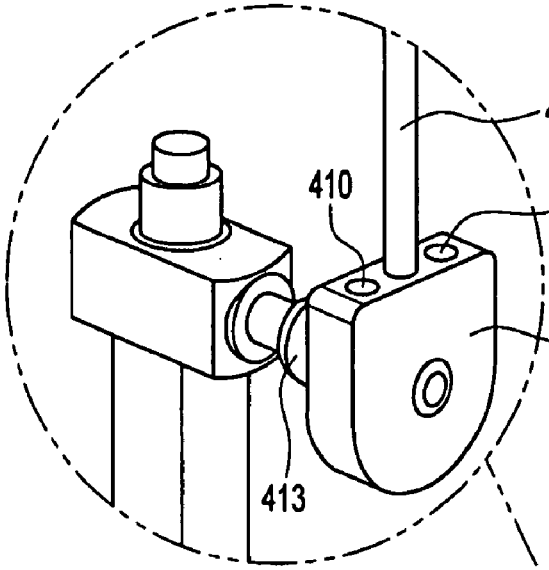
Figure 4:
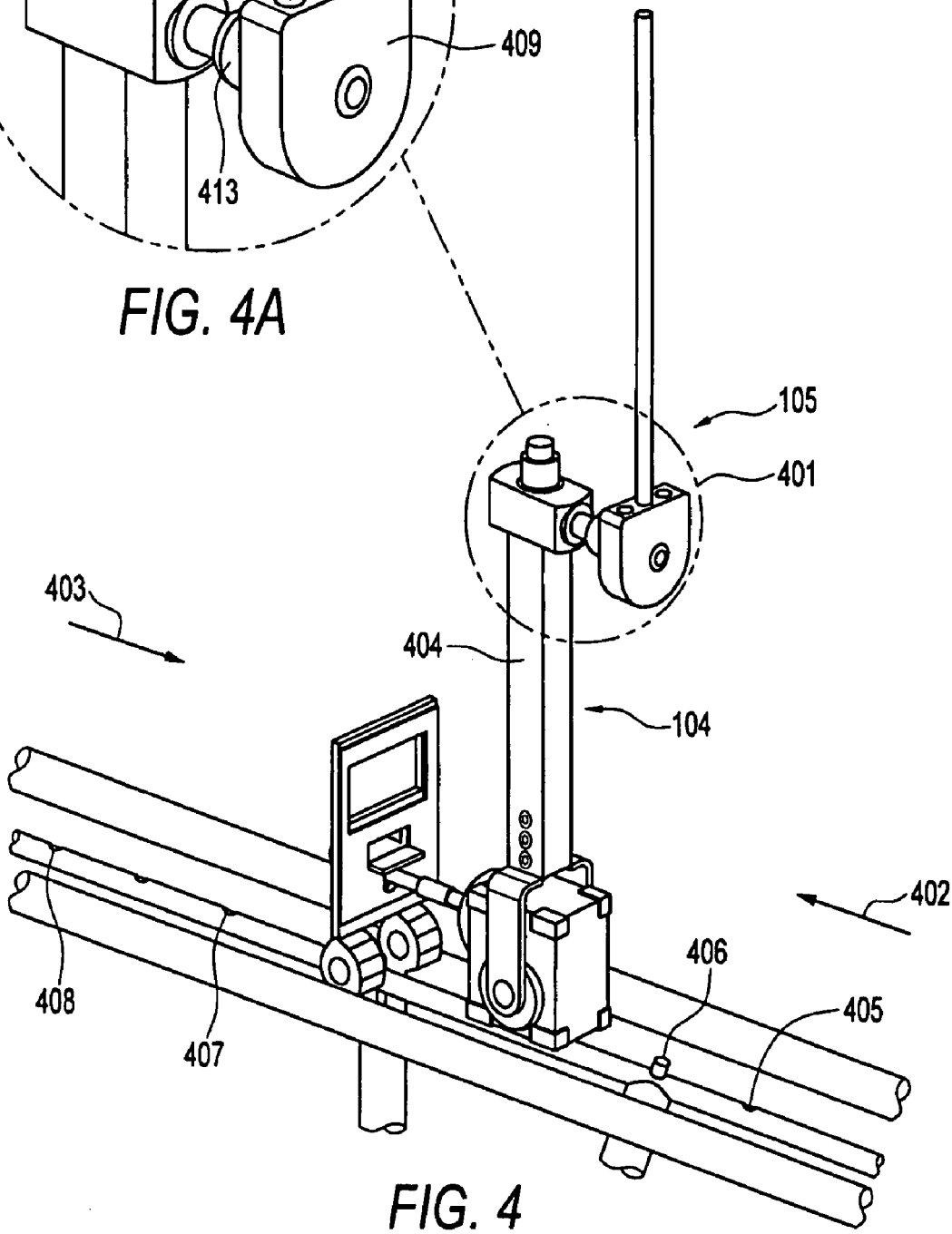
Figure 5:
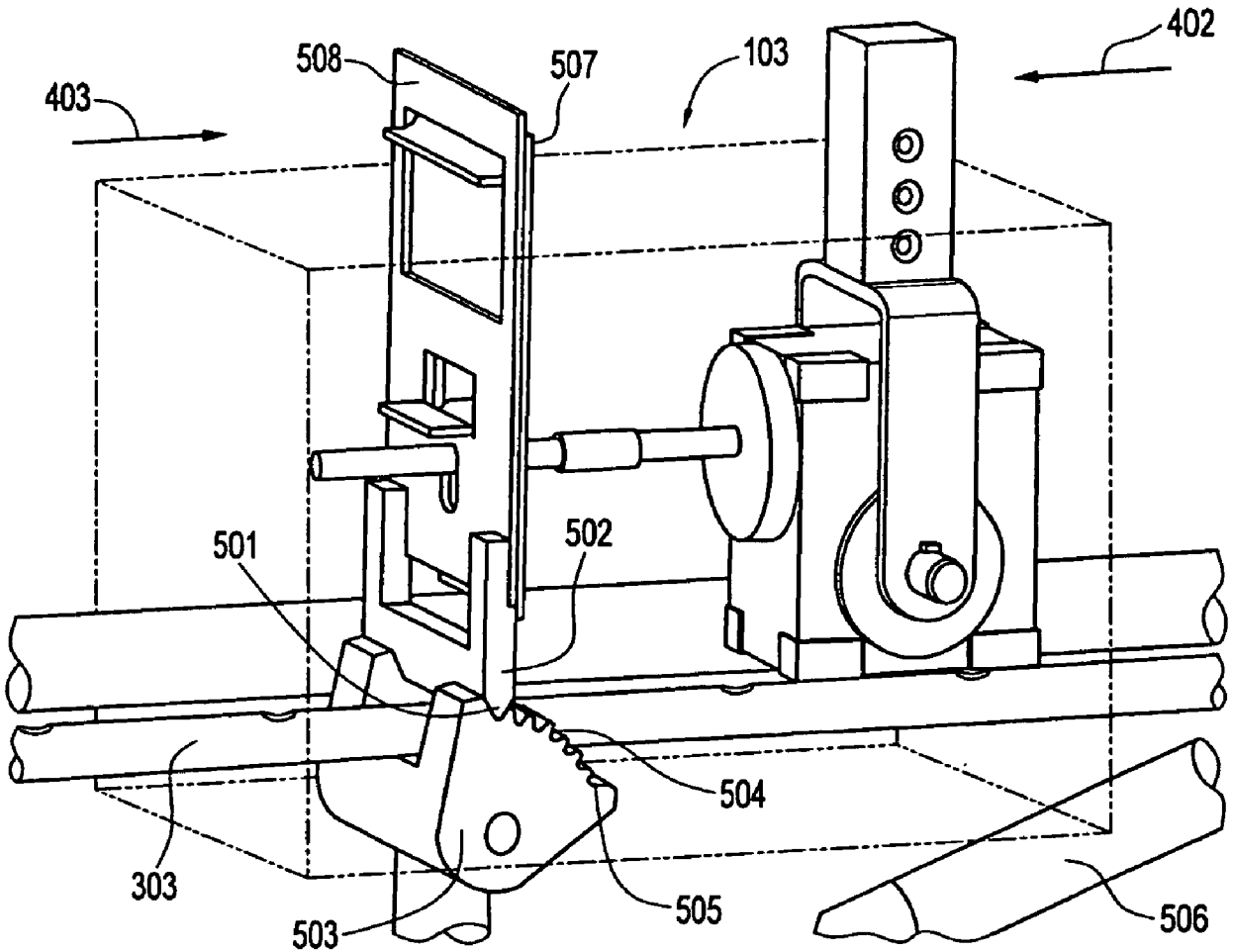
Figure 6:
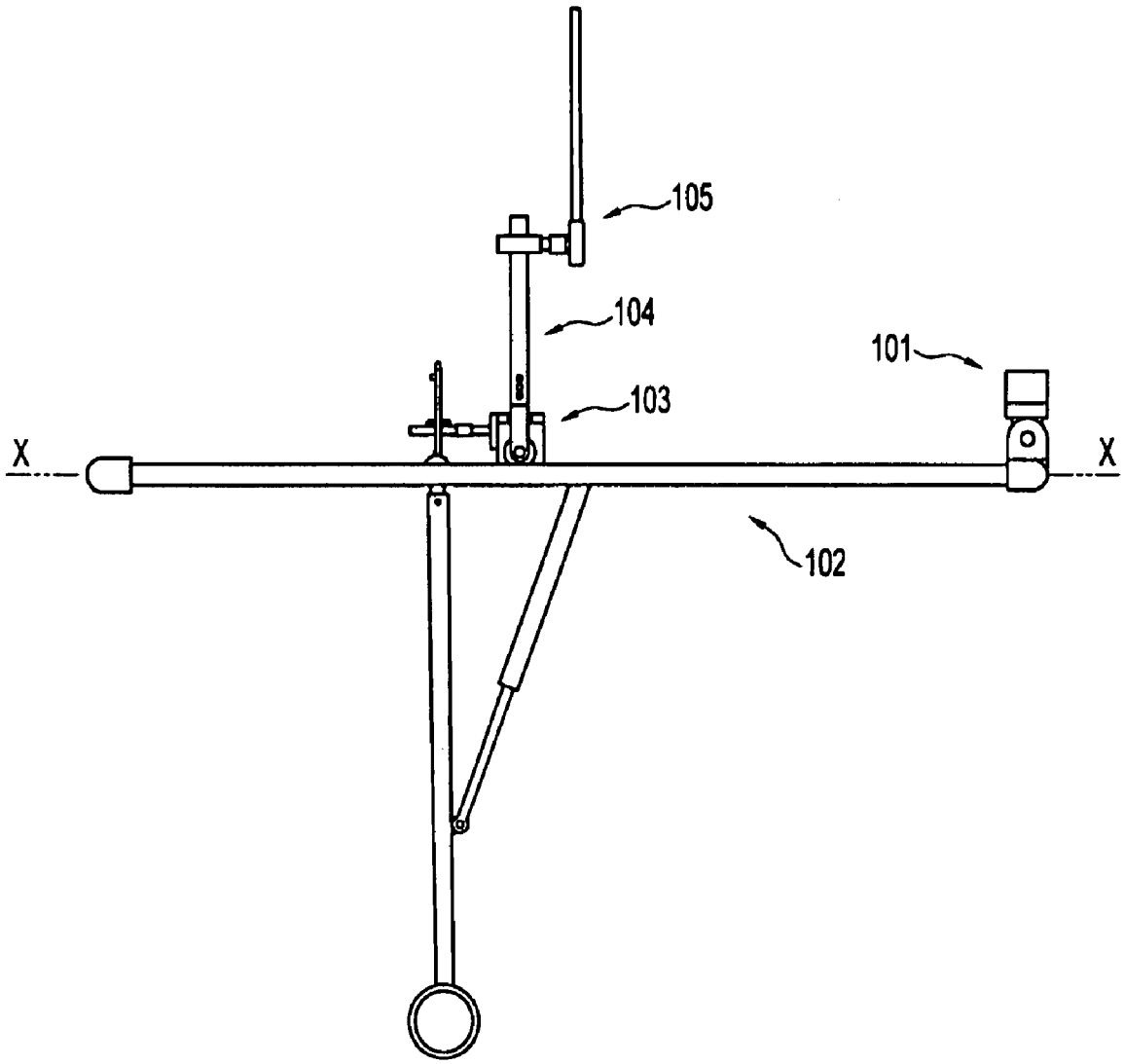
FIG. 6 is a front view of the equipment of FIGS. 2 and 5.
Figure 7:
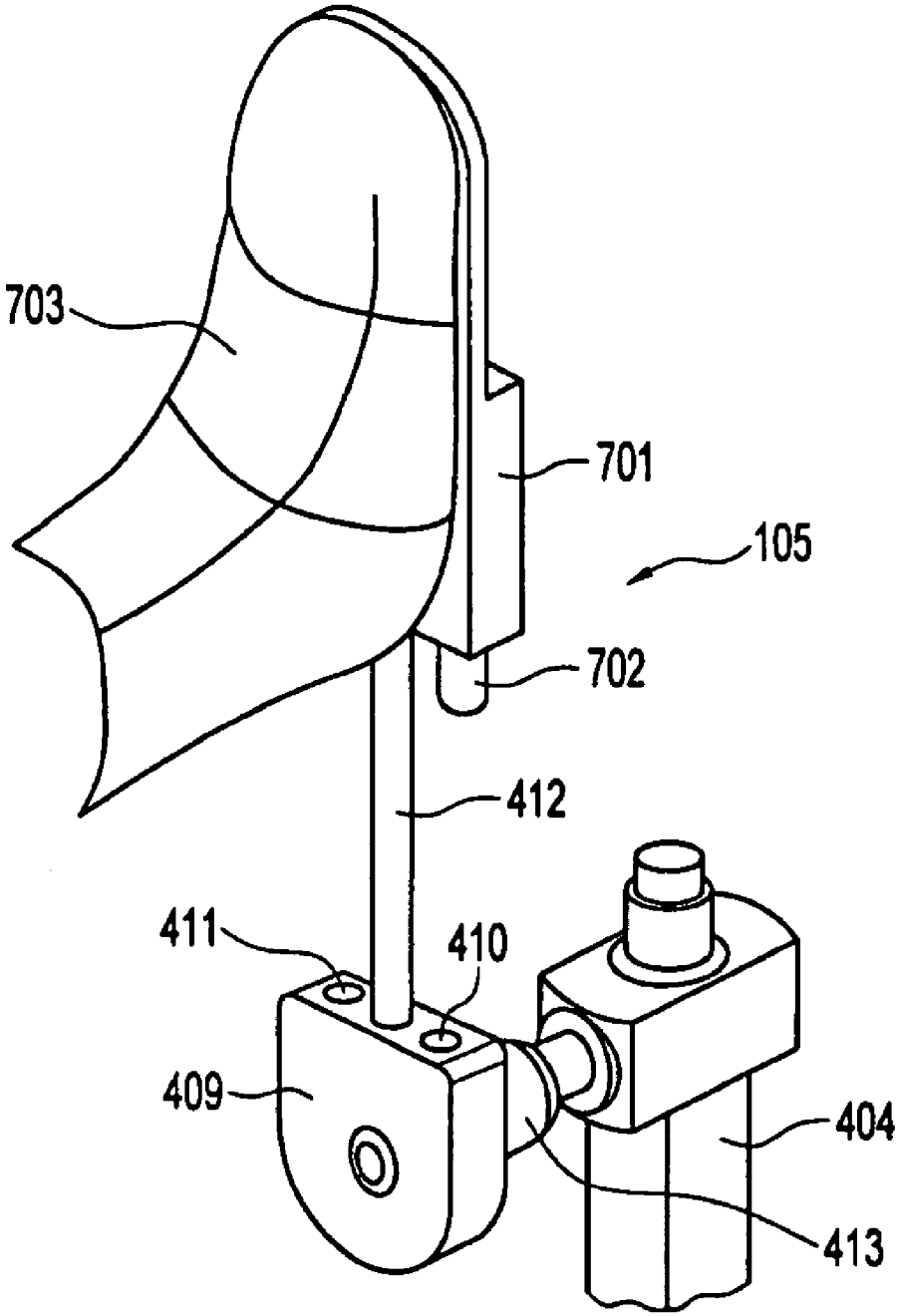
FIG. 7 is a front view of the equipment portion comprised in the circle of FIG. 6.

Sub-system (103) comprises substantially said carriage shown in the circle 202 of FIG. 2 which in its first embodiment of FIG. 4, (representation on enlarged scale of the carriage of FIG. 2) involves a first mechanism (313) to position and fix the carriage on the track thanks to said holes or slits (405-408); in FIG. 5 said mechanism has essentially the form of a cam (502) whose lower end (501) penetrates between the teeth of toothed wheel (503). In the embodiment of FIG. 5 the number of the teeth are six, the inter-teeth empty spaces are seven and the passage from one space to the other determines a rotation (over axis X-X of FIG. 6) of 10° with a total amplitude of 50°.

The carriage mechanism translation along axis X-X (which on its turn can rotate around the fixed axis PF of a total angle of 50°) is schematically represented in FIGS. 4 and 4A which are two views according to arrows (402, 403) of same device.

The fourth system (104) is indicated in the circle 202 and comprises the rod (412) articulated at its lower end on (103).

At the upper end of (104), the rod (412) has an articulation (413) to couple with the fifth subsystem (105) which comprises in itself a housing of support and fixation of limb 703, e.g. in the form of a console (409).

Said console (409) comprises also a number of holes (410, 411) in which penetrates the rod 412 for the engagement of the element (703) (generally) to the patient's foot.

As anticipated a sixth sub-system (106) is preferably present, comprising:—a pneumatically modifiable body (107), e.g. in the form of a cushion, mattress, balloon and the like, located under the lying patient body or limb;—feeding and regulating means of compressed fluid flow (112). The modifiable body (107) is associated to the surgical table (106) whereas the fluid generating and feeding means (112) are incorporated in the converter (110).

A method to embody the system according to the invention comprises the steps of:

Connecting said entire system to a surgery table through said first sub-system (101);

Rough positioning of the carriage of the sub-system (103) along the sub-system (102);

Placing on said to be operated limb, a means for its engagement to sub-system (105);

Fine positioning of sub-system (103) to offer to the surgeon the optimal conditions for translation, rotation and traction of the limb to be operated upon.

For clarity the invention has been described with reference to the simplest embodiment form shown in the accompanying drawings. However it is to be intended that the invention is not limited to said embodiments but is susceptible to all the changes, additions, alternatives and the like, which, being familiar to one of ordinary skill in the art, are to be considered as falling within the scope and spirit of the same invention.

What is claimed is:

1. A system for facilitating surgical operations on limbs of patients lying on a surgery table by extending and positioning the limb to be operated upon, said system comprising:

a first multi-functional articulated sub-system comprising an articulation coupled to the surgery table, with at least three degrees of freedom;

a second sub-system comprising a track with said first sub-system coupled at one end and configured to support and position a patient limb coupling means, with at least two degrees of freedom;

a third sub-system coupled between said second sub-system and a fourth sub-system, with at least one degree of freedom and comprising a carriage mechanism provided with means for its translation, for the rotation of the second sub-system, and the traction of the limb to be operated upon;

the fourth sub-system configured to interconnect said third sub-system and a fifth sub-system, with at least one degree of freedom over the third sub-system;

the fifth sub-system coupled to said fourth sub-system and configured to support the limb to be operated upon, with at least three degrees of freedom.

2. A system according to claim 1, comprising a sixth sub-system to finely optimize the limb position over the surgeon.

3. A system according to claim 2, wherein said sixth sub-system comprises a means to feed and control a compressed fluid flow to an elastic pneumatically modifiable body in the form of a cushion, small mattress, or elongated balloon, said elastic pneumatically modifiable body located under the patient, said feeding and control means being coupled to a converter system and configured to permit a surgeon to finely regulate the height, distance, inclination of the limb relative to the surgeon.

4. A method for embodying the system according to claim 3, comprising the steps of: connecting said converter system to the surgery table through said first sub-system; roughly positioning the carriage mechanism of the third sub-system along the second sub-system; placing on the limb to be operated upon a means for its engagement to the fifth sub-system; finely positioning the third sub-system to offer to the surgeon optimal conditions for translation, rotation, and traction of the limb to be operated; and optionally ultrafinely positioning the limb over the surgeon by pneumatically acting on the feeding and control means.

5. A system according to claim 1, wherein said first sub-system comprises a hinge mechanism.

6. A system according to claim 1, wherein said second sub-system comprises a binary track mechanism provided with a plurality of holes or slits arranged linearly and configured to fix the third sub-system and capable of rotation over a vertical axis.

7. A system according to claim 6, further comprising a means for engaging said carriage mechanism with said holes or slits and a toothed wheel, wherein a plate penetrates inter-teeth empty spaces of the toothed wheel to determine the position of the third, fourth, and fifth sub-systems.

8. A system according to claim 1, wherein said fourth sub-system comprises a shoe which fits to the foot of the limb to be operated upon.

9. A system according to claim 1, wherein said sub-systems are combined with each other during the surgical operation and a command means is coupled to the carriage mechanism while the limb is being preliminarily positioned.

* * * * *